US006351914B1

(12) United States Patent
Sobek

(10) Patent No.: US 6,351,914 B1
(45) Date of Patent: Mar. 5, 2002

(54) LIGHT-TRANSMITTING BUILDING CONSTRUCTION ELEMENT

(75) Inventor: Werner Sobek, Stuttgart (DE)

(73) Assignee: Werner Sobek Ingenieure GmbH, Stuttgart (DE)

( * ) Notice: Subject to any disclaimer, the term of this patent is extended or adjusted under 35 U.S.C. 154(b) by 0 days.

(21) Appl. No.: 09/600,155

(22) PCT Filed: Jan. 26, 1999

(86) PCT No.: PCT/EP99/00465

§ 371 Date: Sep. 11, 2000

§ 102(e) Date: Sep. 11, 2000

(87) PCT Pub. No.: WO99/39060

PCT Pub. Date: Aug. 5, 1999

(30) Foreign Application Priority Data

Jan. 30, 1998 (DE) ..... 198 03 584

(51) Int. Cl.[7] ..... E04B 1/82; E04C 2/54

(52) U.S. Cl. ..... 52/145; 52/783.14; 52/783.17; 52/786.11; 52/787.11; 52/791.1; 52/794.1; 181/289

(58) Field of Search ..... 181/289, 290, 181/291, 292; 52/144, 145, 783.14, 783.17, 786.11, 786.1, 787.11, 789.1, 791.1, 793.1, 794.1

(56) References Cited

U.S. PATENT DOCUMENTS

| | | | | | |
|---|---|---|---|---|---|
| 1,172,710 | A | | 2/1916 | Howe | |
| 2,850,109 | A | * | 9/1958 | Benjamin | |
| 3,875,706 | A | * | 4/1975 | Okawa | 52/712 |
| 4,035,539 | A | * | 7/1977 | Luboshez | 428/178 |
| 4,198,796 | A | * | 4/1980 | Foster | 52/171 X |
| 4,452,230 | A | | 6/1984 | Nelson | |
| H975 | H | * | 11/1991 | Sellkowitz et al. | 52/172 |
| 5,156,894 | A | * | 10/1992 | Hood et al. | 428/34 |
| 5,270,092 | A | | 12/1993 | Griffith et al. | |
| 5,390,467 | A | * | 2/1995 | Shuert | 52/797 |
| 5,532,440 | A | * | 7/1996 | Fujiwara | |
| 5,544,465 | A | * | 8/1996 | Hood et al. | 52/786.13 |
| 5,580,620 | A | * | 12/1996 | Campbell et al. | 428/34 |
| 5,718,096 | A | * | 2/1998 | Nowara | 52/794.1 |
| 6,004,652 | A | * | 12/1999 | Clark | 428/133 |
| 6,250,027 | B1 | * | 6/2001 | Richards | 52/204.59 |

FOREIGN PATENT DOCUMENTS

| | | |
|---|---|---|
| DE | 2212870 | 9/1973 |
| DE | 7317542 | 12/1974 |
| DE | 3503757 A1 | 8/1986 |
| DE | G9205226.6 | 9/1993 |
| DE | 4333522 A1 | 4/1995 |
| DE | 29602179 U1 | 6/1996 |
| EP | 0536078 A1 | 4/1993 |

OTHER PUBLICATIONS

Patent Abstracts of Japan, vol. 015, No. 008 (M–1067), Jan. 9, 1991 & JP 02 258248 (Nitto Denko Corp).

Patent Abstracts of Japan, 06 057836, Mar. 1, 1994.

Patent Abstracts of Japan, 04 300363, Oct. 23, 1992.

* cited by examiner

*Primary Examiner*—Robert Canfield

(74) *Attorney, Agent, or Firm*—Jones, Tullar & Cooper, P.C.

(57) ABSTRACT

A light-transmitting building component, as wall roof or ceiling component etc. is formed with a technical membrane, in the form of a textile tissue on the outward-facing side and, furthermore, by a sound-insulation layer arranged at a distance to the outer layer of the technical membrane, and by and infrared-impeding, light-transmitting layer on the inward-facing side. In this manner, a building component is created which features low surface weight and still meets stringent requirements not only in terms of resistance to climatic influences but also with regard to heat and sound insulation.

25 Claims, 2 Drawing Sheets

LIGHT-TRANSMITTING BUILDING CONSTRUCTION ELEMENT

FIELD OF THE INVENTION

Figure 1:
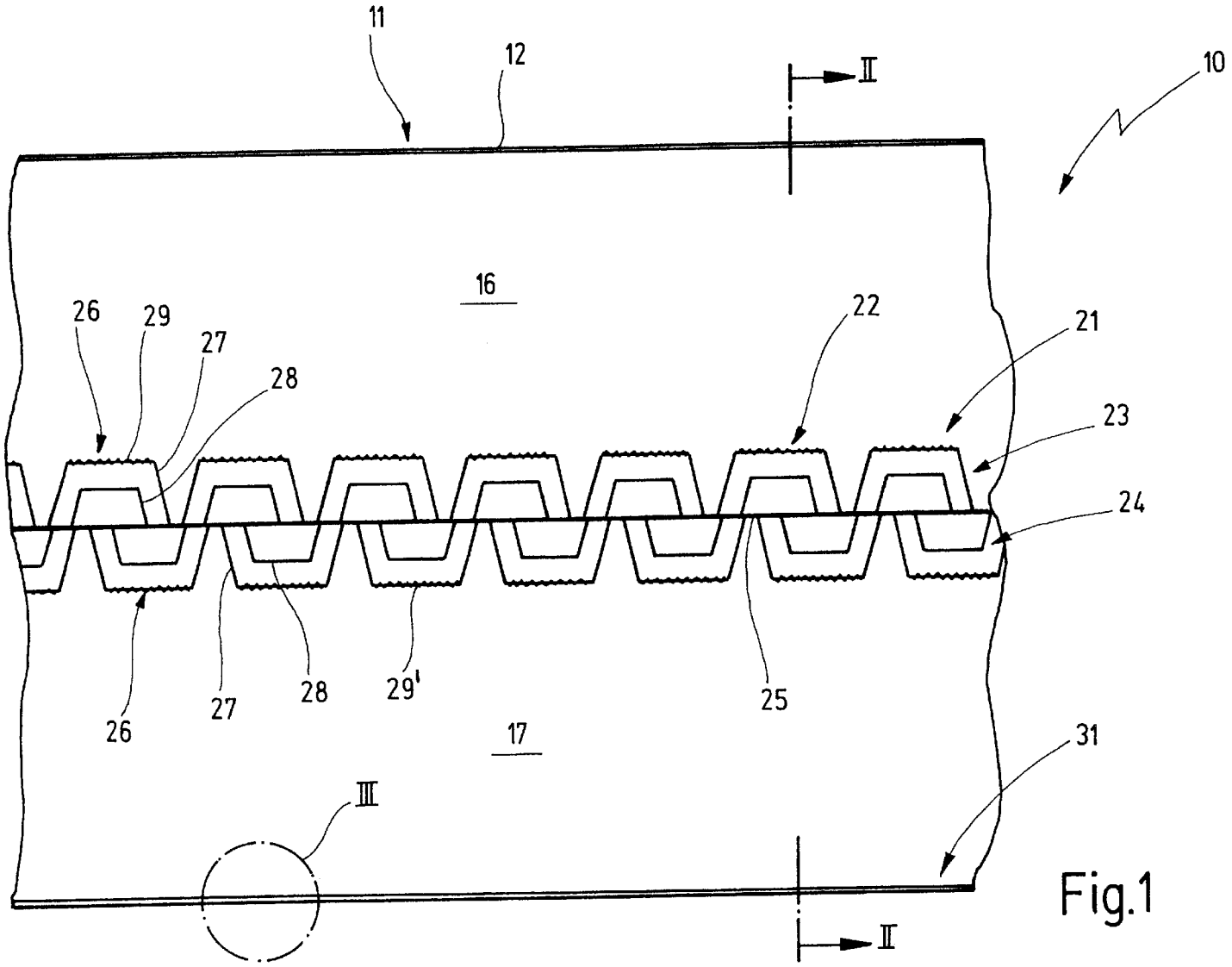

The present invention involves a light-transmitting, specifically a translucent building component, for use as a wall, roof or ceiling component, etc., featuring a technical membrane.

BACKGROUND OF THE INVENTION

Technical membranes are textile surface structures which consist, for example, of systems of threads, warp threads and weft yarns, crossing at right angles, but which can also be made up of foils. Such technical membranes used as building materials serve mainly for primary load reduction for wide-span roof support structures. For such buildings, technical membranes are particularly suitable, due to their low surface weight in conjunction with high tensile strength. Currently, their use is limited to serving as protection against external influences, such as humidity, wind, snow and radiation. If special coatings are planned, these soft bending materials feature behavior which is, for example, anti-adhesive to dirt and highly resistant to decomposition. If there are plans to use this material not only as a bearing element but also as a room-closing component, this will involve requirements in terms of heat and sound insulation, in addition to mechanical properties. However, technical membranes generally have poor heat insulation properties, which raises problems of warming and cooling, together with the corresponding energy cost, as well as heat accumulation and accumulation of condensed water as a result of temperature fluctuations. Due to the influence of manifold internal and external noise sources on the structure or the component, rooms can generally only be used if this noise energy is absorbed by room-closing components of great mass. As a result of their low surface weight, the above-mentioned technical membranes by definition feature poor sound-insulating properties.

Construction designs of room-closing components using technical membranes usually try to solve these problems by using insulating materials in connection with arranging the membrane sometimes in 3 to 5 layers. As a result of the low mass of such a construction, satisfactory results can only be achieved by using very thick sound insulation layers, if at all. It is another disadvantage of such a design that it will admit only very little light transmission or none at all, therefore making the introduction of artificial light necessary, with all its well-known disadvantages in terms of energy cost and loss of comfort.

SUMMARY OF THE INVENTION

It is the purpose of the present invention to provide a light-transmitting, specifically a translucent building component, such as for wall, roof or ceiling components, etc of the type mentioned at the beginning, featuring low surface weight while still meeting stringent requirements not only in terms of resistance to climatic influences but also in terms of heat and sound insulation properties.

To solve this task, a light-transmitting, specifically a translucent building component, serving as a wall, roof or ceiling component, etc. of the type mentioned earlier features the an infrared-impeding, light and sound transmitting layer on the side facing inward.

The steps according to the present invention will achieve such a light-transmitting building component, which is structured in three layers and combines all the essential functions for such a light-transmitting component. The technical membrane on the outward-facing side has the primary purpose of load reduction as well as serving as protection against climatic effects, radiation and humidity. Furthermore, this technical membrane also ensures a high degree of light-transmission. The sound insulation layer acts effectively against both external and internal sources of noise. The inward-facing room-closing layer with infrared-inhibiting effect serves to suppress most of the exchange of long-wave radiation between the room and this layer. Since this layer renders the transmission of infrared rays negligible, the heat radiation hitting this layer from the room is reflected back to the room. In other words, due to the reflection of infrared rays to this inner layer, the thermal comfort in the room is significantly improved and the outward-facing technical membrane is heated up. It is not the outward-facing technical membrane, which absorbs solar rays and heats up as a result, which is reflected but rather the temperature in the room. This lowers the calculated mean temperature of the room-closing surfaces. Thermal comfort, of which, according to Fanger, the calculated mean temperature of the enclosing surfaces is a contributing factor, in addition to the atmospheric temperature, is significantly enhanced. If the inward-facing layer is heated up by short-wave solar radiation, only a small portion of this heat is transmitted into the room. Consequently, in addition to improved comfort, the cooling charge to be evacuated from the room is also considerably reduced.

This infrared-inhibiting, light-transmitting layer could for instance be provided directly at the surface of the sound-insulating layer facing inward toward the room. However, the preferred design for the infrared-inhibiting, light-transmitting layer would be as an inward-facing layer of a plastic foil. It is beneficial if the inward-facing layer of plastic foil is arranged at a distance from the sound-insulation layer.

With the spaces between the individual layers, which are preferably of about equal size, connected to the air in the room or to ambient air, appropriate ventilation openings make possible the ventilation of the three-layered construction of the building component from behind, in conjunction with the thermal lift of the warming air column. This avoids physical construction problems in such intermediate spaces, such as the accumulation of condensation and damage resulting from humidity.

The surface of the plastic foil with the infrared-impeding coating is joined to a support featuring preferably regular perforation and/or the thickness of the plastic foil being significantly smaller than that of the support and that the support features perforations over a significant portion of its surface, preferably about 40 to 60%, ensures that the plastic foil provided with an infrared-inhibiting layer in combination with the perforated support, for instance, permits sound waves generated in the room to pass almost without attenuation, so that these sound waves will then be absorbed by the sound-insulation layer located over it. The passage of sound is consequently minimized to the reflection of the room noise back into the room.

The most advantageous designs for the support, the plastic foil and the infrared-inhibiting layer are those based on fiberglass tissue, non-flammable material and abrasion-resistant, respectively, so that light transmission as well as safety considerations are taken into account, as well as the fact that the layer can be cleaned with non-abrasive cleaning agents without losing its function.

The most advantageous design of the sound-insulating layer is based on the feature of hollow bodies of light-transmitting material which are arranged in a direction against each other and offset with the direction of other arrangements of hollow bodies. The hollow bodies have an approximately rectangular shape and are of a roughly trapezoidal cross-section, with the volume of the inner hollow bodies being small and the material of the hollow bodies being mode of UV-resistant material, which is fire-resistant material. The surfaces of the hollow bodies which face the outer or inner layer of the technical membrane, and are parallel to them, have irregular shapes. The acoustic effectiveness is achieved via the bending resilience of the hollow acoustic bodies or their impact surfaces. With appropriate geometry, these hollow absorber bodies can be installed in a self-supporting manner. For structures of a bigger span, it may be necessary to use auxiliary constructions on which the hollow absorber bodies can then be mounted.

Advantageous design of the outward-facing technical membrane can be achieved on the basis of the outer technical membrane being a textile tissue with a plastic coating, and specifically a fiberglass tissue with a PTFE coating, and with the outer technical member being prestressed and the individually layers being mounted firmly in a frame component and kept at a distance from each other. For example, to prevent long-term damage from humidity, fiberglass threads or siliconised PVC threads are used as base material for weaving the technical membrane. To meet strict requirements in terms of anti-dirt adhesion behavior and decomposition resistance, the bearer tissue of the technical membrane is coated with PVC, PTFE or silicone. One main benefit of this design is that it continues to permit a high degree of light transmission.

Further details about the present invention can be seen in the following description, which explains and describes the invention in more detail, based on the sample design represented in the drawing. This includes the following:

BRIEF DESCRIPTION OF THE INVENTION

Figure 2:
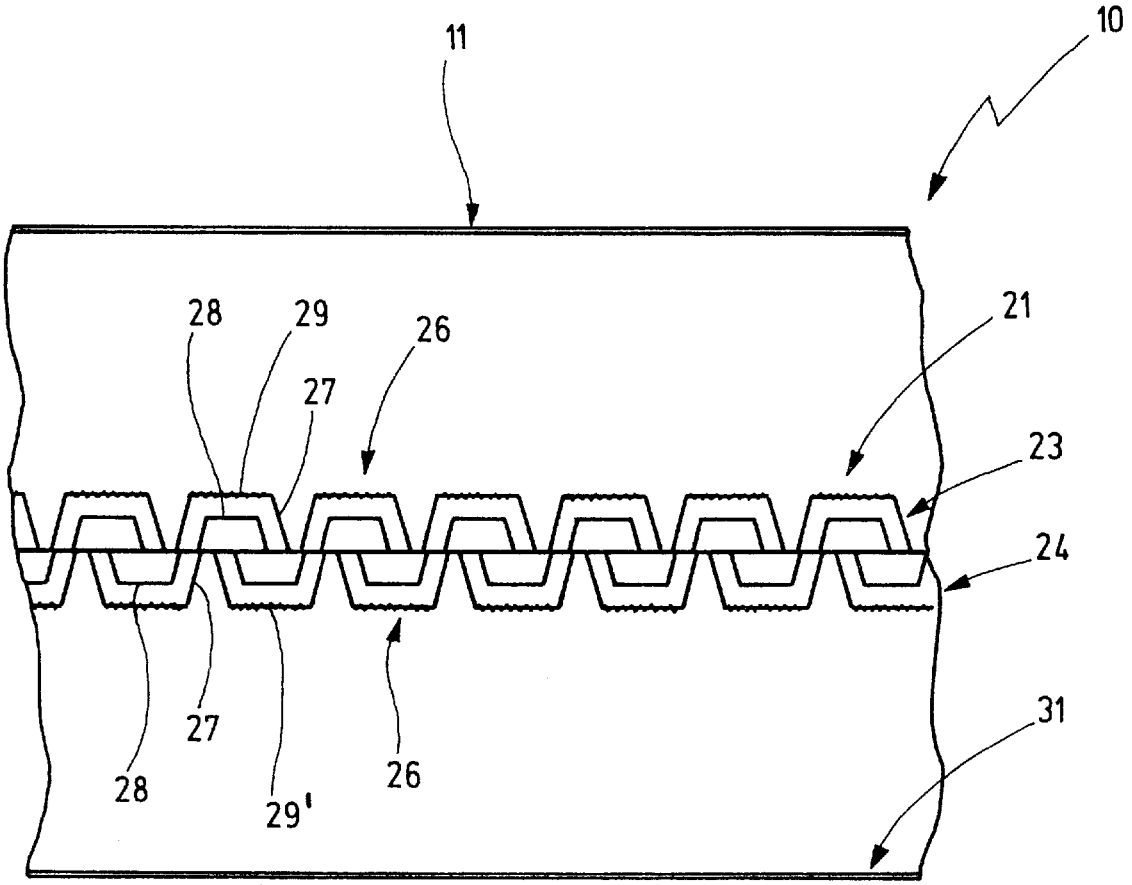
Figure 3:
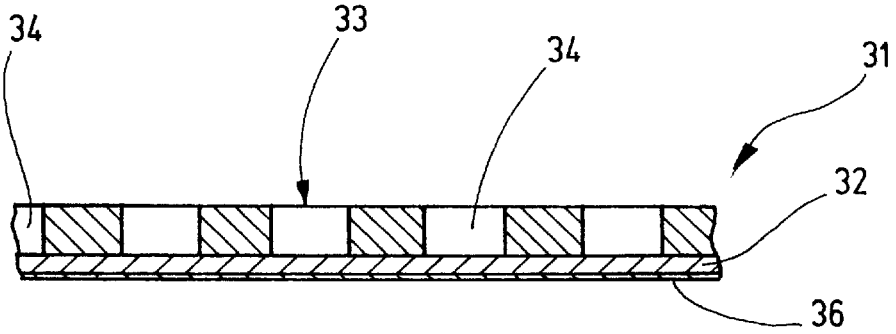

FIG. 1 is a break-off, cross-section representation in diagram form of a light-transmitting building component with a three-layer structure, based on a preferred sample design of the present invention;

FIG. 2 somewhat reduced, is a lengthwise section along the line II—II of FIG. 1, and FIG. 3 an enlarged representation of a section based on circular section III of FIG. 1.

DESCRIPTION OF THE PREFERRED EMBODIMENT

The light-transmitting or translucent building component 10 represented in the drawing can serve as a bearing component in buildings, in the form of a roof or ceiling component or as a room-closing component, particularly in the form of an outer wall component. In all applications, it is essential for the component to feature protection against climatic influences, radiation and humidity, as well as possessing sound and heat insulating properties.

The building component 10 has a three-layered structure, i.e. an outward-facing layer 11, a second, intermediary layer 21 and a third layer 31 on the inward-facing side of the building or structure in question.

The first layer 11 is formed by a technical membrane 12 which consists essentially of a textile tissue; in the form of a weft or knitted tissue or suchlike. The base material of this textile tissue consists of fiberglass threads or plastic threads, such as siliconised PVC threads or Teflon threads. This woven, knitted or other related textile technologies are coated with a plastic substance such as PVC, PTFE, PU or, as mentioned earlier, with silicone, in order to meet stringent requirements of anti-dirt adhesion behavior and decomposition resistance. The technical membrane 12, which is mechanically or pneumatically prestressed, serves for primary load reduction and ensures a high degree of light transmission.

The second, intermediary, layer 21, which is arranged at a specific distance from the technical membrane 12, is made up of light-transmitting, UV-resistant and fire-resistant sound absorbers 22. This sound absorber unit 22 is composed of two sound absorber arrangements 23 and 24 which are directed against each other. In case of building components or structures of a wider span, there may be an auxiliary construction, represented here in the form of a plate or a frame 25. Each of these sound absorber arrangements 23, 24 consists of a great number of twin-hollow bodies 26 which are set in rows and columns. In this sample design they have a basic rectangular shape, while their cross-section is roughly trapezoid. Each twin-hollow body 26 possesses an outer hollow body 27 and an inner hollow body 28 of identical shape but different dimensions, arranged at intervals. The external surface 29 or 29' of the outer hollow body 27 of arrangement 23 or 24 is of irregular shape. The design of the external surface 29, 29' arranged parallel to the first layer affects the bending resilience of the outer hollow body 27, and consequently its acoustic effectiveness.

Although the twin hollow body 26 of sound absorber arrangements 23 and 24 are represented as being individually arranged and held on the frame or plate 25, it is understood that sound absorber arrangements 23 and 24 can be of a single piece and can be installed in a self-supporting manner. The sound absorber arrangements 23 and 24 with their twin hollow 26 bodies are offset in relation to each other, so that the rows and columns of the twin-hollow bodies 26 of on set 23 overlap the other arrangement 24.

The material selected for the twin hollow bodies 26 features 50% transparency. In a manner not represented here, the sound absorber unit 22 can be subjected to modification to serve also for increased heat insulation.

At an additional distance to intermediate layer 21, the third layer 31 is arranged on the side facing inward toward the room. This third layer 31, which can also be referred to as the inner membrane, features a plastic foil 32 of a thickness ranging from 0.01 mm to 0.2 mm. The surface of this plastic foil is mounted on a support tissue 33, which features a great number of regular openings 34, for instance in the form of punched perforations. These openings 34 occupy a large proportion of the total surface of the support tissue 33, for instance from 40 to 60%, but preferably 50%. The support tissue 33 is of considerably greater thickness, for instance about 0.8 mm. The support tissue can be a coated fiberglass tissue. Instead of a support tissue, it is also possible to use a perforated support foil of non-flammable material. Both the support tissue 33 and the plastic foil 32 are light-transmitting, preferably translucent or even transparent.

On the side of the non-flammable plastic foil 32 facing away from the support tissue 33, a light-transmitting but infrared-impeding coating in the form of a low-E coating 36 has been applied. This infrared-impeding coating 36 facing the room has a heat-insulating effect because heat transport via radiation heat is strongly diminished. This suppresses most of the exchange of long-wave radiation between the room in question and the third layer 31. The low-E-coating 36 has been rendered abrasion-resistant by application of a scratch-resistant infrared-transmitting protective coating. It can be cleaned with normal non-abrasive cleaning methods without impeding its function.

The plastic foil 32 in combination with the perforated support tissue 33 makes it possible for sound waves generated in the room to pass through almost unimpeded to the second intermediary layer 21, where they will then be absorbed. This second layer 21 consequently absorbs noise originating from the room as well as noise coming in from outside the building.

In the sample design represented here, the intermediate spaces 16 and 17 between the first layer 11 and the second layer 21 or between the second 21 and the third layer 31 are ventilated from behind, in a manner not represented in detail, by means of ventilation openings directed to the surrounding atmosphere or to the air in the room. This prevents physical construction problems in the intermediate spaces 16 and 17, such as accumulation of condensation or damage from humidity. In the represented sample design, the intervals between layers 11, 21 and 31 are just about equal. It is understood that these intervals may vary, depending on the desired sound and heat insulation properties as well as the desired component thickness.

What is claimed is:

1. A light-transmitting building component, comprising:

an outward-facing side defining an outward-facing layer, and a side facing inward of the building defining an inward-facing layer;

a technical membrane on said outward-facing layer;

a light-transmitting sound and heat insulating layer arranged at a distance from said outward-facing layer; and an infrared-impeding, light and sound-transmitting layer on said inward-facing layer.

2. The light-transmitting building component of claim 1, wherein said technical membrane comprises a textile tissue.

3. The light-transmitting building component of claim 1, wherein said inward-facing layer includes a plastic foil, and said infrared-impeding, light and sound-transmitting layer comprises a coating on the inward facing side of said plastic foil.

4. The light-transmitting building component of claim 3, wherein said plastic foil is arranged at a distance from said light-transmitting sound and heat insulating layer.

5. The light-transmitting building component of claim 1, further comprising:

a space between said outward-facing layer and said light-transmitting sound and heat insulating layer; and a further space between said light-transmitting sound and heat insulating layer and said inward-facing layer, wherein said space and said further space being connected to one of: the air in the room of the building with which the building component is associated, and ambient air.

6. The light-transmitting building component of claim 5, wherein said space and said further space are of about equal size.

7. The light-transmitting building component of claim 3, further comprising:

a support for said plastic foil and said infrared-impeding, light and sound transmitting layer.

8. The light-transmitting building component of claim 7, wherein said support has regular perforations.

9. The light-transmitting building component of claim 8, wherein the thickness of said plastic foil is smaller than that of said support.

10. The light-transmitting building component of claim 9, wherein said support has regular perforations over approximately 40% of its surface.

11. The light-transmitting building component of claim 9, wherein said support has regular perforations over approximately 60% of its surface.

12. The light-transmitting building component of claim 7, wherein said support comprises a fiberglass tissue.

13. The light-transmitting building component of claim 7, wherein said support comprises a non-flammable material.

14. The light-transmitting building component of claim 3, wherein said infrared-impeding, light and sound-transmitting coating is abrasion-resistant.

15. The light-transmitting building component of claim 1, wherein said light-transmitting sound and heat insulating layer features arrangements of hollow bodies of light-transmitting material which arrangements are directed against each other.

16. The light-transmitting building component of claim 15, wherein each arrangement of hollow bodies includes rows and columns of hollow bodies, and wherein said hollow bodies of one arrangement are offset with respect to said hollow bodies of the other arrangement.

17. The flight-transmitting building component of claim 15, wherein said hollow bodies have an approximately rectangular shape and a roughly trapezoidal cross-section.

18. The light-transmitting building component of claim 15, wherein each of said hollow bodies feature an inner hollow body of small volume.

19. The light-transmitting building component of claim 15, wherein each hollow body includes a surface which faces one of: said outward-facing layer and said inward-facing layer, and is parallel thereto, said surfaces having an irregular shape.

20. The light-transmitting building component of claim 15, wherein said hollow bodies are made of UV-resistant material.

21. The light-transmitting building component of claim 15, wherein said hollow bodies are made of fire-resistant material.

22. The light-transmitting building component of claim 2, wherein said textile tissue includes a plastic coating.

23. The light-transmitting building component of claim 22, wherein said technical membrane is a fiberglass tissue with a PTFE coating.

24. The light-transmitting building component of claim 1, wherein said technical membrane is prestressed.

25. The light-transmitting building component of claim 1, further comprising:

wherein said technical membrane, said light-transmitting sound and heat insulating layer and said infrared-impeding, light and sound-transmitting layer are mounted at a distance from each other.

* * * * *